US011026490B2

(12) United States Patent
Parris et al.

(10) Patent No.: US 11,026,490 B2
(45) Date of Patent: Jun. 8, 2021

(54) ASSEMBLY COMPRISING A STYLING TOOL AND A COLLECTING DEVICE

(71) Applicant: L'OREAL, Paris (FR)

(72) Inventors: Eric Parris, Sannois (FR); Gabin Vic, Semoy (FR); Frédéric Woodland, Gagny (FR)

(73) Assignee: L'OREAL, Paris (FR)

( * ) Notice: Subject to any disclaimer, the term of this patent is extended or adjusted under 35 U.S.C. 154(b) by 550 days.

(21) Appl. No.: 15/031,868

(22) PCT Filed: Oct. 24, 2014

(86) PCT No.: PCT/IB2014/065584
§ 371 (c)(1),
(2) Date: Apr. 25, 2016

(87) PCT Pub. No.: WO2015/059667
PCT Pub. Date: Apr. 30, 2015

(65) Prior Publication Data

US 2016/0262517 A1 Sep. 15, 2016

(30) Foreign Application Priority Data

Oct. 25, 2013 (FR) ..... 13 60470

(51) Int. Cl.
*A45D 2/00* (2006.01)
*A45D 19/02* (2006.01)
(Continued)

(52) U.S. Cl.
CPC ..... *A45D 2/001* (2013.01); *A45D 1/04* (2013.01); *A45D 6/00* (2013.01); *A45D 7/02* (2013.01);
(Continued)

(58) Field of Classification Search
CPC ... A45D 1/00; A45D 1/04; A45D 1/06; A45D 1/08; A45D 1/14; A45D 2001/002;
(Continued)

(56) References Cited

U.S. PATENT DOCUMENTS 4,294,270 A 10/1981 Cochran
6,119,702 A * 9/2000 Habibi ..... A45D 1/04 132/118
(Continued)

FOREIGN PATENT DOCUMENTS

FR 2910301 A1 6/2008
WO 2004/008906 A1 1/2004
WO 2011/019861 A2 2/2011

OTHER PUBLICATIONS

Jan. 5, 2015 International Search Report issued in International Patent Application No. PCT/IB2014/065584.
(Continued)

*Primary Examiner* — Heidi M Eide
(74) *Attorney, Agent, or Firm* — Oliff PLC

(57) ABSTRACT

The present invention relates to an assembly including: —a styling tool (5), in particular a straightening iron, to be moved along a lock of hair to which water and/or a cosmetic composition has been applied, and—a collecting device (7) coupled to the styling tool so as to collect a runoff generated during the movement of the tool over the hair on account of the presence of water and/or said composition on the hair, the collecting device having a reservoir (9) for picking up the runoff.

18 Claims, 3 Drawing Sheets

Figure 1:
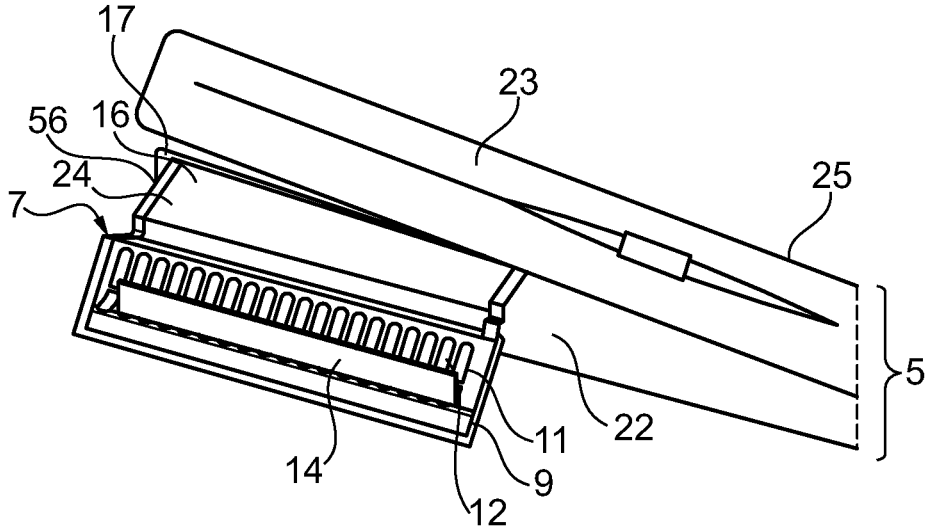

(51) Int. Cl.
*A45D 1/04* (2006.01)
*A45D 6/00* (2006.01)
*A45D 7/02* (2006.01)
*A45D 1/00* (2006.01)

(52) U.S. Cl.
CPC ..... *A45D 19/02* (2013.01); *A45D 2001/002* (2013.01)

(58) Field of Classification Search
CPC .... A45D 2/001; A45D 6/00; A45D 2006/005; A45D 7/02; A45D 2001/008
See application file for complete search history.

(56) References Cited

U.S. PATENT DOCUMENTS 8,146,605 B1* 4/2012 Laaly ..... A45D 1/04 132/118
8,915,779 B1* 12/2014 Jardino ..... A45D 1/00 132/211
2005/0061352 A1* 3/2005 Yao ..... A45D 1/04 132/225
2006/0108344 A1* 5/2006 Kim ..... A45D 1/04 219/225
2007/0215169 A1 9/2007 Daneshvar
2009/0188516 A1* 7/2009 Catini ..... A45D 1/02 132/269
2010/0269848 A1* 10/2010 Morgandi ..... A45D 1/04 132/269
2011/0036822 A1* 2/2011 Johnson ..... A45D 1/04 219/201
2012/0017932 A1* 1/2012 Takehana ..... A45D 1/04 132/211
2012/0111356 A1* 5/2012 Vacheron ..... A45D 1/04 132/228
2012/0272993 A1* 11/2012 Fereyre ..... A45D 1/04 132/221
2013/0153461 A1* 6/2013 Hein ..... A45D 6/00 206/581
2013/0247934 A1* 9/2013 Han ..... A45D 1/18 132/269

OTHER PUBLICATIONS

Jan. 5, 2015 Written Opinion issued in International Patent Application No. PCT/IB2014/065584.

* cited by examiner

ASSEMBLY COMPRISING A STYLING TOOL AND A COLLECTING DEVICE

The present invention relates to devices for treating the hair and their accessories, and more particularly, but not exclusively, those intended for shaping the hair, in particular for straightening, curling or crimping the hair.

The invention relates more particularly to an assembly comprising a styling tool and a collecting device that has the function of collecting a runoff which may be produced by the styling tool as it passes through the hair.

BACKGROUND

Within the scope of a treatment of the hair by a professional or consumer, it is known to use tools to be moved along the length of the hair. During the passage of the tool, the users may need to remove excess water or a cosmetic product from the hair.

The passage of a straightening iron over hair soaked with water and/or cosmetic product can in particular cause an undesirable runoff of water and/or cosmetic product.

In particular, there exist professional care services during which the stylist applies a product to wet hair and then passes a straightening iron over this hair. During this passage of the straightening iron, the product melts and is carried over the lock by the pressure of the gripper of the iron which wrings the hair. This results in significant runs along the straightening iron and at the end of the lock, and these can bring about soiling, this being particularly problematic since some cosmetic hair products can be oxidizing agents or irritants.

There is thus a need to collect the runoffs associated with the passage of a styling tool through the hair, so as to make this act clean and risk-free for the person undergoing the treatment.

SUMMARY

The invention aims to meet this need and its subject is, according to a first of its aspects, an assembly comprising:

a styling tool, in particular a straightening iron, to be moved along a lock of hair to which water and/or a cosmetic composition has been applied, and a collecting device coupled to the styling tool so as to collect a runoff generated during the movement of the tool over the hair on account of the presence of water and/or said composition on the hair, the collecting device having a reservoir for picking up the runoff.

The term "runoff" should be understood as meaning a discharge of fluid, that is to say a liquid or a foam for example, from the hair, in particular under the effect of a wringing pressure and/or heat produced by the styling tool as it passes over the hair.

The expression "cosmetic composition" should be understood as meaning any cosmetic product intended to treat the hair fibre. This composition may be in the liquid, solid or pasty state before being applied to the hair.

The collecting device may comprise a fastening system designed to permanently fasten the device to the styling tool. In one variant, it may also, advantageously, allow removable fastening and the possibility of easily fastening the device to and removing it from the styling tool, and preferably in a satisfactory manner for left-handers and right-handers. In the case of permanent fastening, all or part of the collecting device may be produced, in particular moulded, in one piece with a part of the tool. For example, at least one wall of the reservoir is moulded together with a part of the handle or of one jaw of the tool.

The system for fastening the collecting device to the styling tool may be designed to ensure fastening by:

sliding, snap-fastening, screwing, magnetic attraction, adhesive bonding, binding strap(s): having hooks and loops, in particular of the Velcro® type, by way of pegs, buttoning, press studs, etc.

These fastening means may be used in combination. For example fastening by sliding, followed by screwing of a locking screw or by snap-fastening for locking the collecting device in a predefined position on the tool. The locking can be carried out for example by the creation of a hard point requiring greater effort to be overcome.

The fastening system may be designed to fit a particular tool or a plurality of tools of different sizes, that is to say different lengths and/or widths and/or thicknesses. For example, in the case of a straightening iron and a fastening system with screw locking or with binding strap(s), the fastening system may be adjustable depending on the width and the thickness of the heating plate or handle of the iron to which it is coupled.

In the case of a styling tool having a handle, the fastening system may be located along the axis of the handle or extend parallel to the axis of the handle.

Advantageously, a grating is disposed on the reservoir. The grating allows the product and/or water coming from the lock of hair to run into the reservoir and prevents the fluid that has been collected from spilling out accidentally after use. This grating is preferably removable so as to make it easier to clean the collecting device.

The grating is provided with holes which allow the runoff to pass easily into the reservoir without being able to come back out accidentally. The shape and dimensions of the holes may vary; they may in particular be chosen depending on the viscosity of the runoff. A set of several gratings having different hole shapes and dimensions may be provided so as to allow the user to change the grating based on need. For example, the more viscous the runoff, the more the holes have to have a large size to make it easier for the runoff to pass through the grating. Preferably, the largest dimension of the holes is between 8 and 12 mm, for example around 10 mm, and the repeat pitch of the holes is for example 1 to 2 mm.

The grating may be made of the same material as the rest of the collecting device or be made of a different material. The grating may be moulded in one piece with the reservoir or be manufactured separately and then attached to the reservoir. The grating may be fastened to the reservoir by snap-fastening.

The grating may be connected to a part, in particular in the form of a frame, which is involved in fastening the collecting device to the tool and which may, if appropriate, come into contact with a hot part of the tool, in particular with a heating plate.

The grating may thus be produced from a sheet of metal having a part which is involved in coupling the collecting device to the styling tool, in particular to the heating plate of a straightening iron.

A seal fixed to the abovementioned frame is conceivable to ensure sealing with respect to the plate.

A seal may be present at the interface between the fastening system and the corresponding jaw, for example along the fastening system on that side of the jaw which is located on the reservoir side.

The collecting device may furthermore comprise a retaining member which guides the runoff into the reservoir and through the grating if there is one. This retaining member may be designed in the form of a strip, oriented transversely to the running direction of the fluid. For example, this strip may rise by a few millimetres, preferably between 2 and 12 mm, with respect to the grating. The retaining member may be located close to the downstream edge of the reservoir with respect to the direction of movement of the tool over the hair, such that the opening in the reservoir is mainly located between the styling tool upstream and the retaining member downstream.

The retaining member may be fastened to the grating or formed together therewith or be inserted into a slot provided to this end.

The retaining member may be produced by being moulded in one piece with a wall of the reservoir. In this case, optionally, the grating has an opening for the retaining member to pass through.

The retaining member may also be produced from the same material as the grating, for example by bending a sheet of metal used to produce the grating, by machining or injection-moulding.

The reservoir may be defined by a portion of a shell produced by moulding a thermoplastic material. This shell may comprise an upright portion that rests against that side of the tool that faces away from the reservoir. This upright portion may be connected to the reservoir by a bottom part which extends under the styling tool. This bottom part may carry all or part of the abovementioned fastening system. The shell may be produced so as to be able to slide over the styling tool.

The reservoir has a volume of preferably 5 to 20 ml.

The invention is particularly suitable for the case of a straightening iron in a process for treating hair fibre, during which a care product is melted during the period of contact with the iron.

In the case of a straightening iron, the reservoir is located downstream in the direction of passage and extends along the iron. The collecting device is preferably fastened at least partially to the bottom plate of the iron. The length of the reservoir is advantageously greater than that of the heating plate, in order to make it easier to collect all of the runoff.

Preferably, the opening in the reservoir extends, in the lengthwise direction, beyond each side of the heating plate, preferably by 0.2 to 10 mm, and more preferably by 0.5 to 10 mm. The grating has for example at least one hole on each side of the heating plate.

The collecting device may be produced by being moulded in one piece or by being assembled from various elements. Advantageously, the collecting device is produced from at least one material that is resistant to impacts, to cosmetic products (oxidizing agents, reducing agents, alkalis, acids) and to heat.

Treatment Process

Another subject of the invention is a process for treating hair with the aid of an assembly according to the invention, comprising the steps of:

applying water and/or a cosmetic composition to the hair, passing the styling tool over the hair, and collecting, with the aid of the collecting device coupled to the tool, a runoff of fluid, in particular downstream of the tool, this runoff being due to the presence of water and/or the cosmetic composition on the hair and the passage of the tool.

The step of applying the cosmetic product or water may be carried out independently of that of the passage of the styling tool.

Additionally, a heat treatment is advantageously carried out, by bringing the lock of hair into contact with at least one heating element of the tool, which will for example make it possible to melt, over the period of contact, the cosmetic product previously applied to the hair. This melting will create a runoff which will be collected by the collecting device according to the invention, in its reservoir. An example of such a heat treatment is described in FR 2910301 in the name of the Applicant.

DETAILED DESCRIPTION OF THE FIGURES

Figure 2:
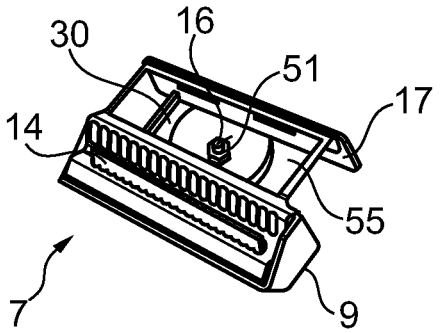
Figure 3:
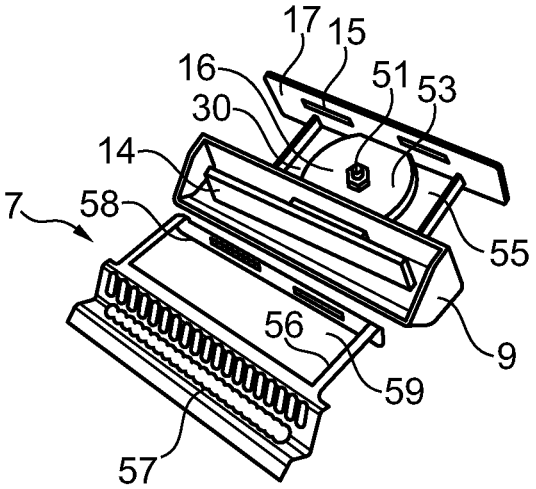
Figure 4:
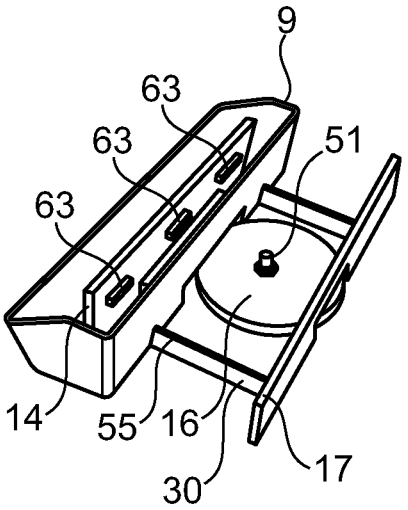
Figure 5:
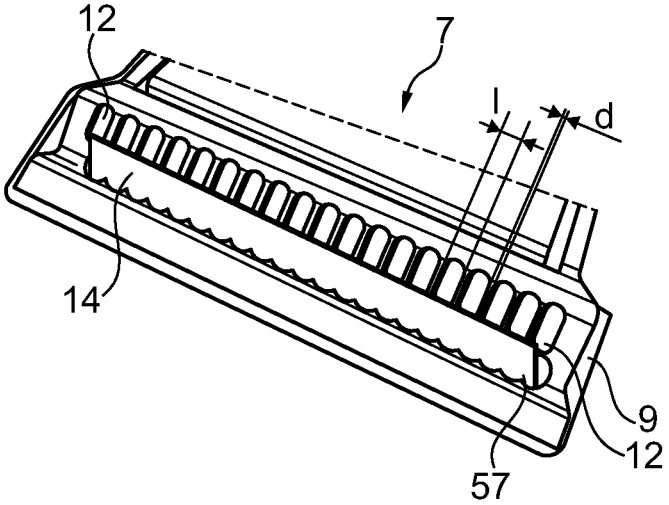
Figure 6:
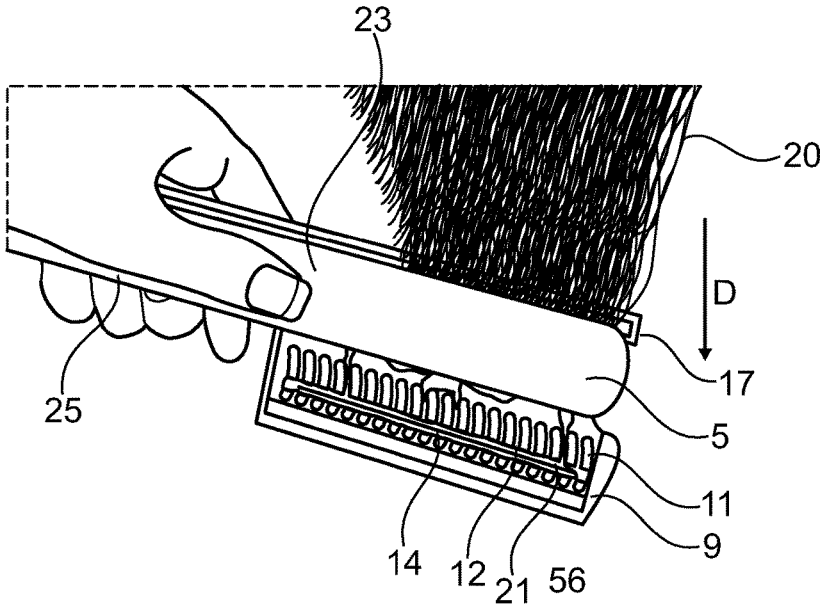
Figure 7:
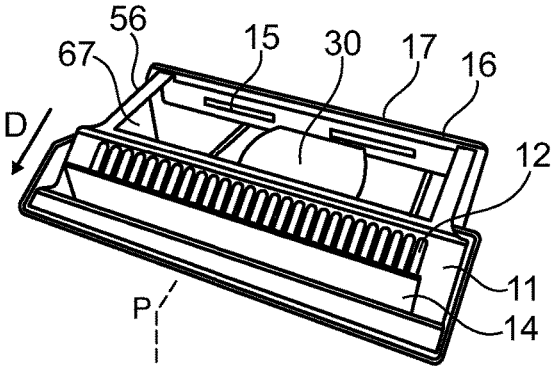
Figure 8:
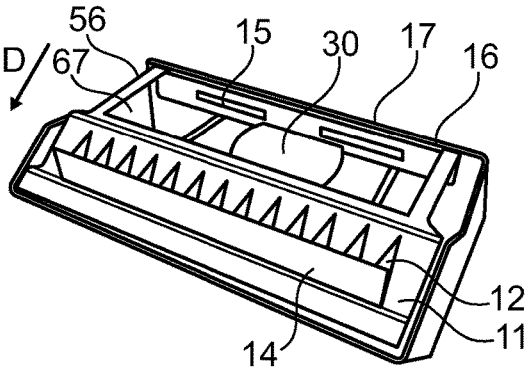
Figure 9:
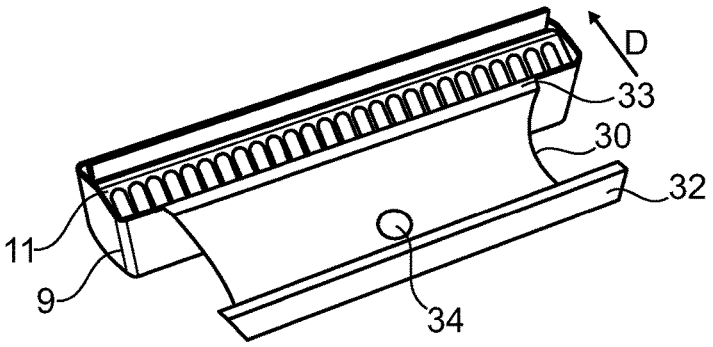
Figure 10:
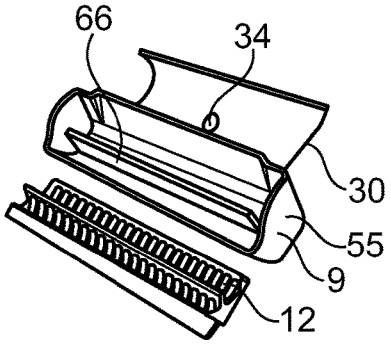
Figure 11:
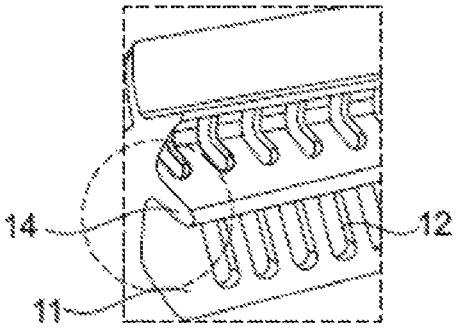
Figure 12:
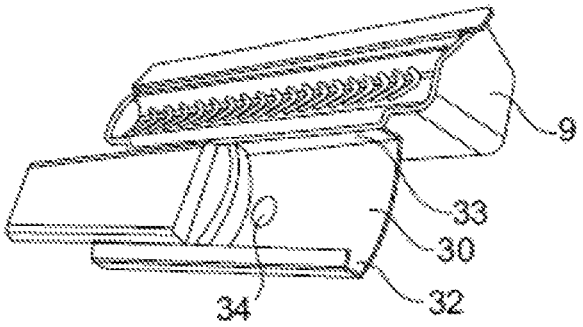
Figure 13:
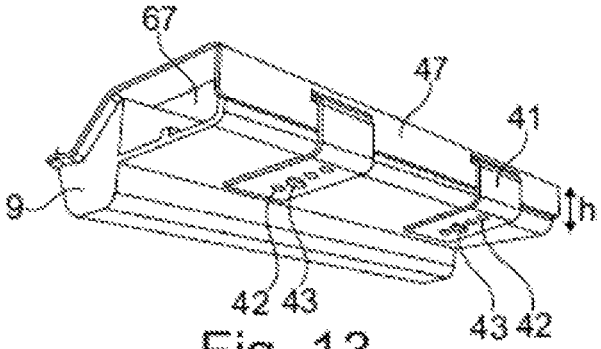
Figure 14:
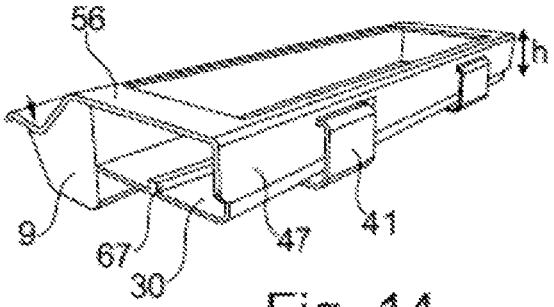
Figure 15:
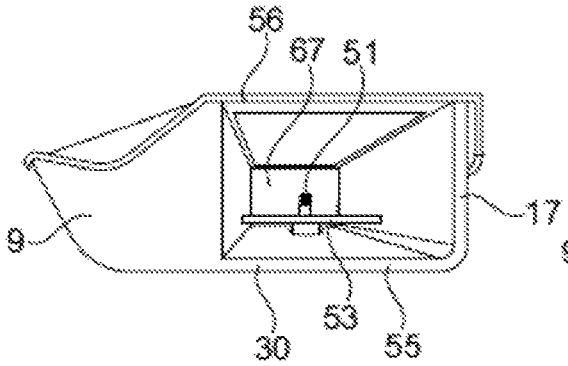
Figure 16:
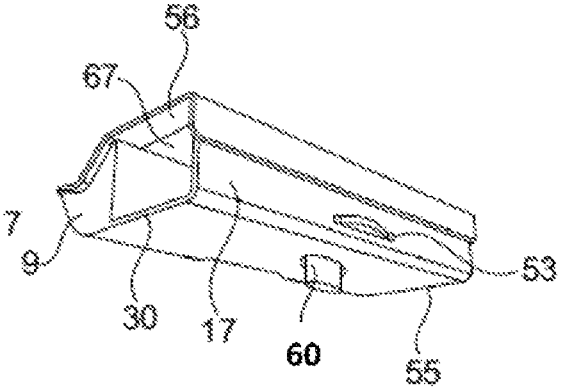

The invention may be better understood from reading the following detailed description of nonlimiting illustrative embodiments thereof and from examining the appended drawing, in which:

FIG. 1 shows an assembly according to the invention, comprising a styling tool coupled to a collecting device equipped with a grating and a retaining member, FIG. 2 shows the collecting device on its own, FIG. 3 shows the collecting device with the reservoir and the grating not assembled, FIG. 4 shows the reservoir on its own, FIG. 5 shows an embodiment detail of the collecting device, FIG. 6 shows an assembly according to the invention while it is being used, FIGS. 7 to 9 show examples of gratings mounted on reservoirs of collecting devices according to the invention, FIG. 10 shows the grating and the reservoir of the collecting device from FIG. 9 in the non-assembled state, FIG. 11 shows an embodiment detail of the grating on its own, FIG. 12 shows the collecting device from FIGS. 9 to 11 while it is being mounted, FIGS. 13 and 14 show a variant embodiment in which the collecting device comprises a system for fastening by way of binding straps, and FIGS. 15 and 16 show a variant embodiment in which the collecting device comprises a system for fastening by way of screwing.

FIG. 1 shows an example of an assembly according to the invention, comprising a styling tool 5 coupled to a collecting device 7.

In this example, the styling device 5 is a straightening iron in the form of grippers, comprising a bottom jaw 22 and a top jaw 23, these being able to pivot with respect to one another. A heating plate 24 is carried by the bottom jaw 22. A handle 25 makes it possible to hold the tool 5.

The collecting device 7 comprises a shell 55 produced by moulding material, said shell 55 defining a reservoir 9.

A part 30 of the shell 55 passes under the bottom jaw 22 and is terminated by an upright portion 17 which rises on that side of the jaw 22 that faces away from the reservoir 9.

In the example in question, a fastening system 16, comprising a bolt 51 that is able to turn by way of a thumb wheel 53 that is accessible to the user from the outside, keeps the collecting device 7 on the tool 5.

The bolt 51 can engage with a nut or thread present on the bottom jaw 22 on the side facing away from the top jaw.

In the example in question, the reservoir 9 is equipped with a grating 11 having holes 12 that allow a runoff coming from the lock of hair during treatment by the tool 5 to pass through the grating 11 and then to prevent the collected runoff from coming back out of the reservoir 9 accidentally. The holes 12 in the grating 11 preferably have an elongate shape transversely to the length of the reservoir. The holes 12 have for example a width l of between 3 and 5 mm, for example of 4 mm, and are spaced apart by a distance d of between 0.5 and 2 mm, for example of 1 mm.

In the example in question, the collecting device 7 is provided with a retaining member 14 which makes it possible to guide the runoff into the reservoir 9.

This retaining member 14 is advantageously in the form of a strip which is positioned transversely to the plane of the grating 11, in the longitudinal direction of the reservoir 9, and rises, for example, by 8 to 12 mm, in particular 10 mm, with respect to the grating 11.

In the example in question, the retaining member 14 passes through the grating 11 by virtue of a slot 57 provided thereon to this end, said slot 57 being visible more particularly in FIG. 3.

In this example, the retaining member 14 is integral with the reservoir 9 because it is moulded in one piece therewith.

The length of the retaining member 14 corresponds substantially to that of the heating plate 24 of the straightening iron 5, while the grating 11 is advantageously a little longer and, as illustrated in FIG. 5, extends beyond each side of the heating plate 24, thereby making it possible to more easily collect all of the runoff that results from the passage of the straightening iron 5 over the hair 20. In particular, at least one hole 12 may be present beyond each end of the retaining member 14, in the extension thereof.

The grating 11 may be produced by cutting and bending a metal sheet, with a frame 56 which helps to couple it to the shell 55.

This frame 56 may have a side 58 away from the grating 11 which has slots 59 that engage with corresponding reliefs 15 provided on that face of the upright portion 17 that faces the grating 11. A seal (not shown) may be interposed between the heating plate and the frame 56, being for example disposed on the internal perimeter of the frame 56.

The retaining member 14 may, as illustrated, have teeth 63 on its face that faces the upright portion 17, as illustrated in FIG. 4, and these teeth 63 may be positioned above the slot 57 so as to keep the grating 11 in place on the reservoir 9.

During the mounting of the collecting device 7 on the bottom jaw 22, the latter is housed in a space 67 defined between the reservoir 9 and the upright portion 17, the frame 56 being positioned around the heating plate and the bottom part 30 under the bottom jaw.

Preferably, the grating 11 is coupled to the shell 55 so as to allow the grating 11 to be removed for cleaning.

FIG. 6 shows an assembly according to the invention, similar to the one which has just been described, while it is being used: the passage of the styling tool 5 along a lock of hair 20 in the direction D wrings the hair and produces a runoff 21 which is collected downstream of the styling tool 5 by the collecting device 7. The runoff 21 passes through the holes 12 in the grating 11 in order to be collected in the reservoir 9. The retaining member 14 makes it possible to guide the runoff 21 into the holes 12 in the grating 11 and to avoid runs of surplus runoff for the time it takes for the runoff to discharge entirely into the reservoir 9 or if the reservoir 9 is full.

In FIG. 6, the collecting device 7 is fastened to the right-hand side of the bottom jaw 22 of the straightening iron 5 and the user uses his or her left hand to pass the assembly according to the invention over the lock of hair 20.

FIGS. 7 and 8 illustrate two other examples of a collecting device 7 according to the invention on its own, each of these being equipped with a grating 11 and a retaining member 14.

In these examples, the collecting device 7, as in the one in FIGS. 1 to 5, has a frame 56 which, in the case of coupling to a straightening iron (not shown in these figures), is positioned around the heating plate of the bottom jaw 22.

In FIG. 7, the holes 12 in the grating 11 have an elongate shape transversely to the length of the reservoir and are organized in a single row.

The retaining member 14 is positioned on the downstream edge of that part of the grating 11 that has holes, and not set back therefrom as in FIGS. 1 to 5.

In FIG. 8, the holes 12 in the grating 11 have a triangular shape, the base of which is located by the retaining member 14 and the tip of which is located by the styling tool 5 (not shown in the figure).

Numerous other shapes of holes are possible without departing from the scope of the present invention.

The collecting device 7 preferably has a mid-plane of symmetry P (visible in particular in FIG. 7) so as to be able to be used both by left-handers and by right-handers, by being placed on one side of the styling tool or on the other. Thus, the collecting device 7 is mounted on the left-hand side of the straightening iron in FIG. 1 and on the right-hand side in FIG. 6.

FIG. 9 shows a variant embodiment of a collecting device 7 according to the invention, the fastening system of which works by sliding and snap-fastening. The bottom part 30 of the collecting device 7 passes under the bottom jaw of the styling tool. Lips 32 and 33 ensure the snap-fastening to or sliding along the lateral edges of this jaw, as illustrated in FIG. 12.

Advantageously, a flexible contact point 34, such as an elastically deformable button or peg, is positioned in the bottom part 30 next to the tool in order to apply a relief thereto which makes it possible to retain the collecting device 7 relative to the bottom jaw 22 by pressure at the end of the sliding movement.

In order to remove the collecting device 7, it is sufficient for the user to reverse the sliding movement by causing the flexible contact point 34 to yield.

In the variant in FIGS. 9 to 12, the retaining member 14 is produced in one piece with the grating 11 and no longer belongs to the shell 55.

The shell 55 can nevertheless retain an internal partition 66, under the grating 11, which reduces the risk of accidental outlet of the collected product during movements of the tool 5. A seal (not shown) can be interposed between the jaw and the lip 33, along the jaw.

FIGS. 13 and 14 show a variant embodiment of a collecting device 7 in which the fastening system uses binding straps 41.

The straps 41, which are preferably made at least partially from an elastically deformable material, are, in the example in question, equipped with buttonholes 42 into each of which a button 43 can be introduced. The latter has a head having dimensions slightly greater than those of the buttonhole 42, so as to ensure that the corresponding strap is fastened. The straps 41 are fastened to one side 47 of the frame 56.

If need be, the frame 56 can lift during mounting on the styling tool (not shown in FIGS. 13 and 14) by deforming elastically.

The binding straps 41 can be kept in the bound state in some other way than with the aid of buttonholes, for example by way of a Velcro® fastener or self-adhesive or press-stud fastening.

The use of fastening bands 41 makes it possible, advantageously, to fasten and remove the collecting device 7 quickly and easily. In addition, such a fastening system makes it possible to be able to fasten the collecting device 7 to styling tools having varied shapes, and in particular thicknesses.

FIGS. 15 and 16 show a variant embodiment of a collecting device 7 in which the fastening system works by screwing, in a similar manner to the one described with reference to FIGS. 1 to 5.

The thumb wheel 53 makes it possible to move the bolt 51 up or down, thereby locking the collecting device 7 to the styling tool. This bolt 51 may engage in a corresponding housing provided in the styling tool. The bolt 51 is prevented from rotating but can move axially in an extension 60 of the shell 55 of the collecting device when the thumb wheel 53 is rotated.

The invention is not limited to a straightening iron as the styling tool. The tool may also be:

a comb to which the collecting device can be fastened, an appliance for caring for, shaping, dyeing or bleaching the hair and/or any instrument that brings about heating as long as these bring about a runoff during their passage.

The expression "comprising a" is synonymous with "comprising at least one".

The invention claimed is:

1. Assembly comprising:

a straightening iron to be moved along a lock of hair to which water in a liquid form and/or a cosmetic composition in a liquid or foam form has been applied, the straightening iron comprising:

a bottom jaw and an upper jaw connected together by a hinge, the bottom jaw and the upper jaw being able to move relative to one another between a moved-together configuration for treating the hair and a spaced-apart configuration for inserting the hair to be treated between said jaws, and at least one heating plate disposed on one of the bottom and upper jaws and intended to come into contact with the hair while the bottom and upper jaws are in the moved-together configuration, and a collecting device coupled to the bottom jaw so as to collect a liquid or foam runoff generated during the movement of the straightening iron over the hair on account of the presence of water and/or said composition on the hair, the collecting device comprising:

a reservoir for picking up the runoff, the reservoir comprising an opening for collecting the liquid or foam runoff in the reservoir, the reservoir being closed except for the opening that collects the liquid or foam runoff in the reservoir, a fastening system to couple the collecting device in a removable manner to the bottom jaw, and a grating disposed on the reservoir in the opening, the reservoir extending along the straightening iron, on a lateral side of the bottom jaw that is downstream of the heating plate with regard to a direction of movement of the straightening iron over the lock of hair, and laterally relative to the bottom and upper jaws.

2. Assembly according to claim 1, wherein the grating is disposed in a removable manner on the reservoir.

3. Assembly according to claim 1, wherein the grating has holes the largest dimension of which is less than or equal to 10 mm.

4. Assembly according to claim 1, wherein the fastening system is adjustable to the bottom jaw on which it is fastened.

5. Assembly according to claim 1, wherein the fastening system is configured to couple the collecting device in a removable manner to the bottom jaw by sliding.

6. Assembly according to claim 1, wherein the fastening system is configured to couple the collecting device in a removable manner to the bottom jaw by snap-fastening.

7. Assembly according to claim 1, wherein the fastening system is configured to couple the collecting device in a removable manner to the bottom jaw by screwing.

8. Assembly according to claim 1, wherein the fastening system is configured to couple the collecting device in a removable manner to the bottom jaw with the aid of a closable clamping member.

9. Assembly according to claim 1, wherein the reservoir of the collecting device has a capacity of between 5 and 20 ml.

10. Assembly according to claim 1, wherein the reservoir is equipped with a retaining member that forms a barrier to the runoff and causes it to flow into the reservoir through the opening that extends between the straightening iron and the retaining member.

11. Assembly according to claim 10, wherein the retaining member comprises a strip extending transversely to a plane of the grating.

12. Assembly according to claim 1, wherein the collecting device is configured to be fastened to either one side of the straightening iron or the other in order for the latter to be used by left-handed or right-handed persons.

13. A cosmetic method for treating hair with the aid of an assembly comprising:

a straightening iron to be moved along a lock of hair comprising:

a bottom jaw and an upper jaw connected together by a hinge, the bottom jaw and the upper jaw being able to move relative to one another between a moved-together configuration for treating the hair and a spaced-apart configuration for inserting hair to be treated between said jaws, and at least one heating element disposed on one of the jaws and intended to come into contact with the hair while the jaws are in the moved-together configuration, and a collecting device coupled to the bottom jaw of the straightening iron, the collecting device having a reservoir, the collecting device comprising a fastening system to couple the collecting device to the bottom jaw, the reservoir extending along the straightening iron and laterally on the side of the bottom jaw, the method comprising:

applying water in a liquid form and/or a cosmetic composition in a liquid or foam form to the hair, passing the straightening iron over the hair, and collecting, with the aid of the collecting device, a runoff of liquid or foam in the reservoir due to the presence of water and/or the cosmetic composition on the hair and the passage of the straightening iron.

14. Method for treating hair according to claim 13, wherein the application of the water and/or the cosmetic composition to the hair is carried out independently of the passage of the straightening iron over the hair.

15. Method for treating hair according to claim 13, wherein:

the water is applied to the hair during the application step and/or the cosmetic composition is applied to the hair during the application step, and the passage of the heating element along the hair brings about the runoff resulting from the melting of a compound of the cosmetic composition previously applied to the hair.

16. Method for treating hair according to claim 13, wherein the collecting device is fastened in a removable manner to the straightening iron.

17. Method for treating hair according to claim 13, wherein the collecting device is fastened in a permanent manner to the straightening iron.

18. Method for treating hair according to claim 13, wherein the collecting device is disposed downstream of the heating element with regard to a direction of movement of the straightening iron over the lock of hair.

* * * * *